US009500973B2

(12) United States Patent
Tsujihiro et al.

(10) Patent No.: US 9,500,973 B2
(45) Date of Patent: Nov. 22, 2016

(54) TONER

(71) Applicant: KYOCERA Document Solutions Inc., Osaka (JP)

(72) Inventors: Masami Tsujihiro, Osaka (JP); Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 21 days.

(21) Appl. No.: 14/505,741

(22) Filed: Oct. 3, 2014

(65) Prior Publication Data

US 2015/0099221 A1 Apr. 9, 2015

(30) Foreign Application Priority Data

Oct. 8, 2013 (JP) ..... 2013-210665

(51) Int. Cl.
*G03G 9/00* (2006.01)
*G03G 9/093* (2006.01)

(52) U.S. Cl.
CPC ..... *G03G 9/093* (2013.01); *G03G 9/0935* (2013.01); *G03G 9/09307* (2013.01); *G03G 9/09321* (2013.01); *G03G 9/09392* (2013.01)

(58) Field of Classification Search
CPC ..... G03G 9/093; G03G 9/09307; G03G 9/09321; G03G 9/09392; G03G 9/0935
USPC ..... 430/110.2, 109.5
See application file for complete search history.

(56) References Cited

U.S. PATENT DOCUMENTS

| | | | | |
|---|---|---|---|---|
| 5,958,640 | A | 9/1999 | Hasegawa et al. | |
| 6,033,822 | A | 3/2000 | Hasegawa et al. | |
| 2005/0271964 | A1 | 12/2005 | Etou et al. | |
| 2008/0076054 | A1* | 3/2008 | Nozaki ..... | G03G 9/0806 430/110.2 |

FOREIGN PATENT DOCUMENTS

| | | | |
|---|---|---|---|
| JP | 2003-098723 | A | 4/2003 |
| JP | 2004-294469 | A | 10/2004 |
| JP | 2007-063550 | A | 3/2007 |
| JP | 2013-083682 | A | 5/2013 |

* cited by examiner

*Primary Examiner* — Thorl Chea
(74) *Attorney, Agent, or Firm* — Studebaker & Brackett PC

(57) ABSTRACT

For at least 80% of toner particles in a toner, along at least 80% of circumferential length of a toner particle cross-section, a shell layer has a thickness of at least 5 nm and satisfies a condition that a ratio of an intensity INc relative to an intensity INs is no greater than 0.2. For at least 80% of the toner particles in the toner, along at least 80% of the circumferential length of the toner particle cross-section, the shell layer has a thickness of at least 5 nm and satisfies a condition that a ratio of an intensity ISc relative to an intensity ISs is no greater than 0.2.

5 Claims, 10 Drawing Sheets

| Item number | X coordinate | Y coordinate | Density |
|---|---|---|---|
| 1 | 31 | 151 | 22.4 |
| 2 | 103 | 134 | 6.7 |
| 3 | 165 | 104 | 13.7 |
| 4 | 194 | 150 | 2.7 |
| 5 | 256 | 146 | 9.4 |
| 6 | 318 | 128 | 8.6 |
| 7 | 341 | 154 | 12.5 |
| 8 | 442 | 162 | 3.9 |
| 9 | 457 | 113 | 31.0 |
| 10 | 410 | 128 | 13.7 |
| 11 | 253 | 119 | 1.2 |
| 12 | 146 | 174 | 5.1 |
| 13 | 91 | 163 | 8.2 |
| 14 | 72 | 121 | 5.5 |
| 15 | 52 | 166 | 1.2 |
| 16 | 72 | 140 | 14.9 |
| 17 | 146 | 148 | 7.5 |
| 18 | 138 | 120 | 0.0 |
| 19 | 175 | 124 | 2.7 |
| 20 | 212 | 119 | 0.0 |
| 21 | 217 | 168 | 7.5 |
| 22 | 274 | 171 | 1.6 |
| 23 | 299 | 142 | 9.0 |
| 24 | 316 | 176 | 1.2 |
| 25 | 396 | 175 | 6.7 |
| 26 | 380 | 149 | 7.8 |
| 27 | 369 | 120 | 1.2 |
| 28 | 429 | 144 | 9.4 |
| 29 | 463 | 170 | 0.4 |
| 30 | 475 | 142 | 4.3 |
| 31 | 227 | 136 | 0.8 |
| ・ | ・ | ・ | ・ |
| ・ | ・ | ・ | ・ |
| ・ | ・ | ・ | ・ |

| Item number | X coordinate | Y coordinate | Density |
|---|---|---|---|
| ・ | ・ | ・ | ・ |
| ・ | ・ | ・ | ・ |
| ・ | ・ | ・ | ・ |
| 72 | 349 | 101 | 16.9 |
| 73 | 297 | 109 | 0.4 |
| 74 | 303 | 121 | 14.5 |
| 75 | 273 | 115 | 5.1 |
| 76 | 243 | 111 | 3.5 |
| 77 | 241 | 144 | 3.5 |
| 78 | 193 | 107 | 1.6 |
| 79 | 419 | 159 | 4.3 |
| 80 | 419 | 184 | 2.4 |
| 81 | 397 | 151 | 0.4 |
| 82 | 375 | 172 | 0.4 |
| 83 | 454 | 141 | 2.7 |
| 84 | 453 | 178 | 3.9 |
| 85 | 454 | 155 | 0.4 |
| 86 | 434 | 122 | 10.6 |
| 87 | 474 | 113 | 14.1 |
| 88 | 435 | 102 | 14.1 |
| 89 | 239 | 154 | 0.0 |
| 90 | 275 | 185 | 8.6 |
| 91 | 139 | 184 | 4.3 |
| 92 | 104 | 186 | 0.4 |
| 93 | 93 | 178 | 1.2 |
| 94 | 122 | 124 | 13.3 |
| 95 | 134 | 133 | 12.5 |
| 96 | 105 | 145 | 16.5 |
| 97 | 111 | 157 | 4.3 |
| 98 | 9 | 152 | 0.8 |
| 99 | 9 | 165 | 0.0 |
| 100 | 50 | 140 | 3.5 |
| | | Average value | 6.82 |

FIG. 7

| View | Particle 1 | Particle 2 | | Particle 94 | Particle 95 | Particle 96 | Particle 97 | Particle 98 | Particle 99 | Particle 100 |
|---|---|---|---|---|---|---|---|---|---|---|
| 1 | 0.84 | 0.94 | | 0.96 | 0.71 | 0.91 | 0.85 | 0.74 | 0.78 | 0.73 |
| 2 | 0.77 | 0.82 | | 0.89 | 0.85 | 0.84 | 0.86 | 0.74 | 0.85 | 0.95 |
| 3 | 0.80 | 0.96 | | 0.91 | 0.76 | 0.78 | 0.90 | 0.80 | 0.76 | 0.93 |
| 4 | 0.72 | 0.89 | | 0.97 | 0.77 | 0.92 | 0.82 | 0.74 | 0.70 | 0.90 |
| 5 | 0.86 | 0.75 | | 0.83 | 0.82 | 0.95 | 0.82 | 0.95 | 0.87 | 0.82 |
| 6 | 0.93 | 0.86 | | 0.78 | 0.95 | 0.72 | 0.82 | 0.92 | 0.85 | 0.84 |
| 7 | 0.87 | 0.86 | | 0.71 | 0.72 | 0.69 | 0.85 | 0.76 | 0.86 | 0.71 |
| 8 | 0.72 | 0.74 | | 0.77 | 0.96 | 0.88 | 0.80 | 0.79 | 0.78 | 0.81 |
| ⋮ | ⋮ | ⋮ | | ⋮ | ⋮ | ⋮ | ⋮ | ⋮ | ⋮ | ⋮ |
| 21 | 0.89 | 0.78 | | 0.72 | 0.87 | 0.90 | 0.92 | 0.72 | 0.97 | 0.93 |
| 22 | 0.78 | 0.79 | | 0.86 | 0.93 | 0.92 | 0.85 | 0.86 | 0.79 | 0.90 |
| 23 | 0.85 | 0.76 | | 0.81 | 0.96 | 0.82 | 0.93 | 0.93 | 0.73 | 0.88 |
| 24 | 0.87 | 0.84 | | 0.84 | 0.93 | 0.86 | 0.89 | 0.83 | 0.95 | 0.83 |
| 25 | 0.71 | 0.85 | | 0.80 | 0.90 | 0.84 | 0.87 | 0.81 | 0.83 | 0.75 |
| 26 | 0.86 | 0.96 | | 0.81 | 0.73 | 0.77 | 0.83 | 0.75 | 0.93 | 0.83 |
| 27 | 0.96 | 0.92 | | 0.79 | 0.80 | 0.74 | 0.84 | 0.75 | 0.77 | 0.79 |
| 28 | 0.77 | 0.92 | | 0.91 | 0.88 | 0.79 | 0.83 | 0.95 | 0.85 | 0.80 |
| 29 | 0.75 | 0.83 | | 0.79 | 0.77 | 0.81 | 0.86 | 0.71 | 0.82 | 0.91 |
| 30 | 0.86 | 0.75 | | 0.82 | 0.78 | 0.76 | 0.89 | 0.72 | 0.85 | 0.74 |
| Average value | 0.833 | 0.866 | | 0.829 | 0.832 | 0.853 | 0.807 | 0.833 | 0.817 | 0.831 |
| Number of conforming particles 98 | 1 | 1 | | 1 | 1 | 1 | 1 | 1 | 1 | 1 |

FIG. 9

TONER

INCORPORATION BY REFERENCE

The present application claims priority under 35 U.S.C. §119 to Japanese Patent Application No. 2013-210665, filed Oct. 8, 2013. The contents of this application are incorporated herein by reference in their entirety.

BACKGROUND

The present disclosure relates to a toner and in particular relates to a capsule toner.

A capsule toner includes cores and shell layers (capsule layers) formed on the surface of the cores.

SUMMARY

A toner according to the present disclosure includes toner particles, each including a core and a shell layer covering a surface of the core. For at least 80% by number of the toner particles, along at least 80% of a circumferential length of a cross-section of the toner particle when the cross-section is analyzed by electron energy loss spectroscopy (EELS), the shell layer has a thickness of at least 5 nm and satisfies a condition that a ratio of an intensity INc relative to an intensity INs is at least 0.0 and no greater than 0.2. Also, for at least 80% by number of the toner particles, along at least 80% of the circumferential length of the cross-section of the toner particle when the cross-section is analyzed by EELS, the shell layer has a thickness of at least 5 nm and satisfies a condition that a ratio of an intensity ISc relative to an intensity ISs is at least 0.0 and no greater than 0.2. The intensity INs indicates intensity of an N-K shell absorption-edge originating from nitrogen atoms in the shell layer. The intensity INc indicates intensity of an N-K shell absorption-edge originating from nitrogen atoms in the core. The intensity ISs indicates intensity of an S-K shell absorption-edge originating from sulfur atoms in the shell layer. The intensity ISc indicates intensity of an S-K shell absorption-edge originating from sulfur atoms in the core.

BRIEF DESCRIPTION OF THE DRAWINGS

FIG. 7 is a diagram relating to a method for measuring EELS intensity of a core in an example of the present disclosure.

FIG. 9 is a diagram relating to a method for calculating a coverage ratio of a core in an example of the present disclosure.

DETAILED DESCRIPTION

The following describes an embodiment of the present disclosure.

A toner according to the present embodiment is a capsule toner for developing an electrostatic image. The toner according to the present embodiment includes a large number of particles (herein referred to as toner particles). The toner according to the present embodiment can for example be used in an electrophotographic apparatus.

The electrophotographic apparatus uses a toner-containing developer to develop an electrostatic image. Through the development, electrically charged toner adheres to an electrostatic latent image which is formed on a photosensitive body. The toner is transferred onto a transfer belt as a toner image. The toner image on the transfer belt is subsequently transferred onto a recording medium (for example, paper) and is fixed to the recording medium through heating. Through the above process, an image is formed on the recording medium. A full-color image can be obtained by superimposing toner images formed using different colors, such as black, yellow, magenta, and cyan.

Figure 1:
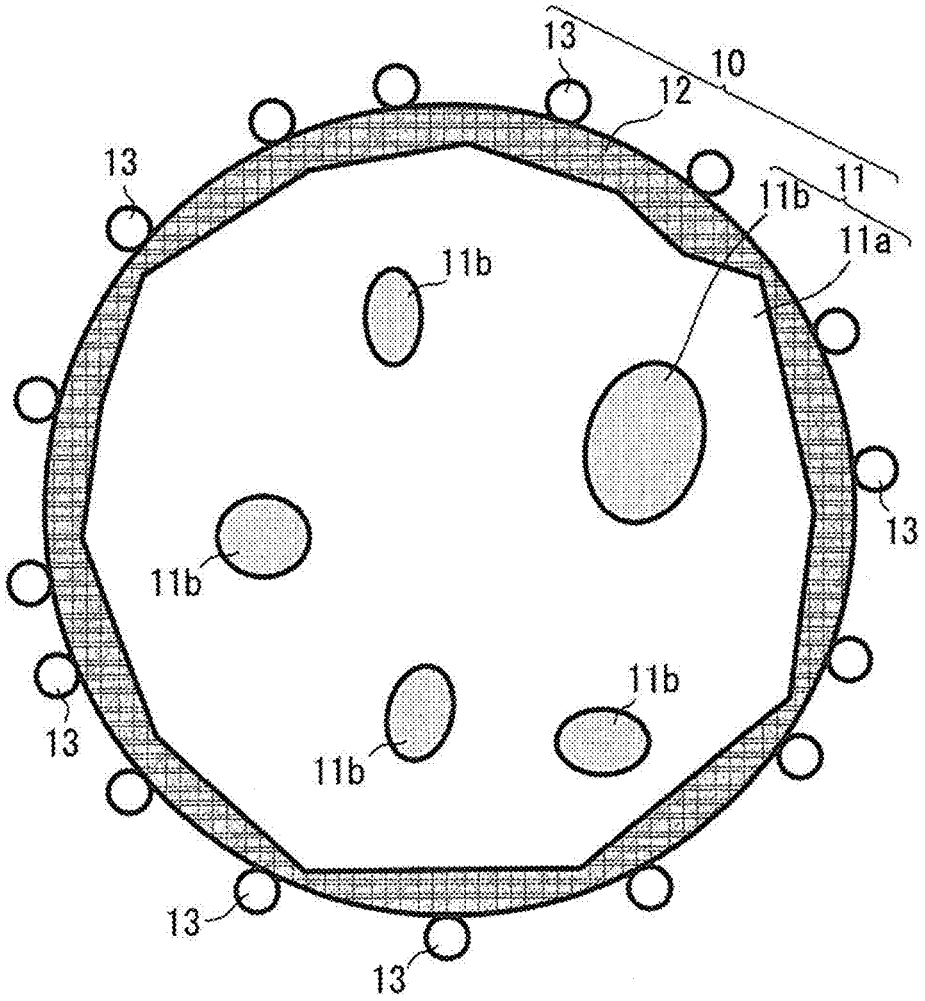
FIG. 1 illustrates a toner particle included in a toner according to an embodiment of the present disclosure.

The following explains composition of the toner (in particular the toner particles) according to the present embodiment with reference to FIG. 1. FIG. 1 illustrates a toner particle 10 included in the toner according to the embodiment of the present disclosure.

As illustrated in FIG. 1, the toner particle 10 includes a core 11, a shell layer (capsule layer) 12 formed on the surface of the core 11, and an external additive 13.

The core 11 contains a binder resin 11*a*. The core 11 may also include one or more internal additives 11*b* (for example a colorant, a releasing agent, a charge control agent and a magnetic powder). The core 11 is covered by the shell layer 12. The external additive 13 may adhere to the surface of the shell layer 12.

The internal additive 11*b* and the external additive 13 may alternatively be omitted depending on necessity thereof. Also, the toner particle may alternatively include a plurality of shell layers 12 formed on the surface of the core 11. In a situation in which the toner particle includes a plurality of shell layers 12 that are layered on one another, an outermost of the shell layers 12 is preferably cationic.

It is preferable that the core 11 is anionic and that a material of the shell layer 12 (herein referred to as a shell material) is cationic. The core 11 being anionic means that the cationic shell material can be attracted toward the surface of the core 11 during formation of the shell layer 12. For example, the shell material, which is positively charged in an aqueous medium, is electrically attracted toward the core 11, which is negatively charged in the aqueous medium, and the shell layer 12 is for example formed on the surface of the core 11 through in-situ polymerization. Through the above process, shell layers 12 can easily be formed in a uniform manner on the surface of cores 11 without necessity to use a dispersant in order to cause a high degree of dispersion of the cores 11 in the aqueous medium.

In the present embodiment, the zeta potential of the cores 11 having a negative polarity (i.e., being less than 0 V) when measured in an aqueous medium adjusted to pH 4 is used as an indicator that the cores 11 are anionic. In order to increase bonding strength of the cores 11 and the shell layers 12, the zeta potential of the cores 11 at pH 4 is preferably less than 0 V and the zeta potential of the toner particles 10 at pH 4 is preferably greater than 0 V. Note that in the present embodiment pH 4 is equivalent to the pH of the aqueous solution during formation of the shell layers 12.

Examples of methods for measuring the zeta potential include an electrophoresis method, an ultrasound method, and an electric sonic amplitude (ESA) method.

The electrophoresis method involves applying an electrical field to a liquid dispersion of particles, causing electrical migration of charged particles in the dispersion, and measuring the zeta potential based on the migration speed. An example of the electrophoresis method is laser Doppler electrophoresis in which migrating particles are irradiated with laser light and the migration speed of the particles is calculated from an amount of Doppler shift of scattered light that is obtained. Advantages of laser Doppler electrophoresis are a lack of necessity for particle concentration in the dispersion to be high, a low number of parameters being necessary for calculating the zeta potential, and a good degree of sensitivity in migration speed detection.

The ultrasound method involves irradiating a liquid dispersion of particles with ultrasound, causing vibration of electrically charged particles in the dispersion, and measuring the zeta potential based on an electric potential difference that arises due to the vibration.

The ESA method involves applying a high frequency voltage to a liquid dispersion of particles, thereby causing electrically charged particles in the dispersion to vibrate and generate ultrasound. The zeta potential is calculated from magnitude (intensity) of the ultrasound.

An advantage of the ultrasound method and the ESA method is that the zeta potential can be measured to a good degree of sensitivity even when particle concentration of the dispersion is high (for example, exceeding 20% by mass).

In order to reduce drainage load, preferably a dispersant (surfactant) is not used during formation of the cores 11 or during formation of the shell layers 12. A dispersant typically has a high drainage load. When a dispersant is not used, the amount of water used during a washing process can be reduced. Also, when a dispersant is not used, total organic carbon (TOC) concentration of drainage discharged during preparation of the toner particles 10 can be kept at a low level, not exceeding 15 mg/L, without diluting the drainage.

An organic component (for example, unreacted monomers, prepolymers, and the dispersant) of drainage can be measured by measuring biochemical oxygen demand (BOD), chemical oxygen demand (COD), or TOC. Among the above, TOC concentration can be used to reliably measure all organic compounds. Also, measurement of TOC concentration can identify an amount of the organic component of drainage (all filtrates and washing solutions produced after reaction) that is unrelated to capsulation.

The following explains, in order, the cores 11, the shell layers 12, and the external additive 13, which are components of the toner particles 10. Note that in the following explanation (meth)acrylic acid is used as a generic term referring to both acrylic acid and methacrylic acid.

[Cores]

The cores 11 contain a binder resin 11*a*. The cores 11 may also contain one or more internal additives 11*b* (for example, a colorant, a releasing agent, a charge control agent, and a magnetic powder). Non-essential components (for example, the colorant, the releasing agent, the charge control agent, and the magnetic powder) may alternatively be omitted in accordance with intended use of the toner.

[Binder Resin (Cores)]

The binder resin 11*a* constitutes a large proportion (for example, at least 85% by mass) of content of the cores 11. Therefore, the polarity of the binder resin 11*a* has a significant influence on the overall polarity of the cores 11. For example, when the binder resin 11*a* has an ester group, a hydroxyl group, an ether group, an acid group, or a methyl group, the cores 11 have a strong tendency to be anionic. On the other hand, when the binder resin 11*a* for example has an amino group, an amine, or an amide group, the cores 11 have a strong tendency to be cationic.

In order that the binder resin 11*a* is strongly anionic, a hydroxyl value (OHV value) and an acid value (AV value) of the binder resin 11*a* are preferably each at least 10 mg KOH/g, and more preferably at least 20 mg KOH/g.

A glass transition point (Tg) of the binder resin 11*a* is preferably no greater than the curing initiation temperature of a thermosetting resin contained in the shell layers 12. As a result of Tg satisfying the above condition, the binder resin 11*a* enables sufficient fixability even during high-speed fixing. The curing initiation temperature of the thermosetting resin (in particular, a melamine based resin) is commonly approximately 55° C. Tg of the binder resin 11*a* is preferably at least 20° C., more preferably at least 30° C. and no greater than 55° C., and particularly preferably at least 30° C. and no greater than 50° C. When Tg of the binder resin 11*a* is at least 20° C., the cores 11 have a low tendency to aggregate during formation of the shell layers 12.

Tg of the binder resin 11*a* can be measured by calculating a heat absorption curve of the binder resin 11*a* using a differential scanning calorimeter (for example, DSC-6200 manufactured by Seiko Instruments Inc.) and calculating Tg from an inflection point of specific heat on the heat absorption curve. In a more specific example, 10 mg of a measurement sample is added to an aluminum pan and an empty aluminum pan is used as a reference. The heat absorption curve of the binder resin 11*a* is calculated through measurements in a temperature range from 25° C. to 200° C. and at a heating rate of 10° C./minute. Tg is calculated from the heat absorption curve.

A softening point (Tm) of the binder resin 11*a* is preferably no greater than 100° C. and more preferably no greater than 80° C. Tm of the binder resin 11*a* being no greater than 100° C. (more preferably no greater than 80° C.) enables sufficient fixability even during high-speed fixing. Tm of the binder resin 11*a* can be adjusted through combination of a plurality of binder resins that each have a different Tm.

Tm of the binder resin 11*a* can be measured by an elevated flow tester (for example, CFT-500D manufactured by Shimadzu Corporation). For example, a measurement sample is set in the elevated flow tester and an S-shaped curve (S-shaped curve of stroke [mm]/temperature [° C.]) is calculated by causing melt-flow of the sample under specific conditions. Tm of the binder resin 11*a* is read from the S-shaped curve that is calculated.

Figure 2:
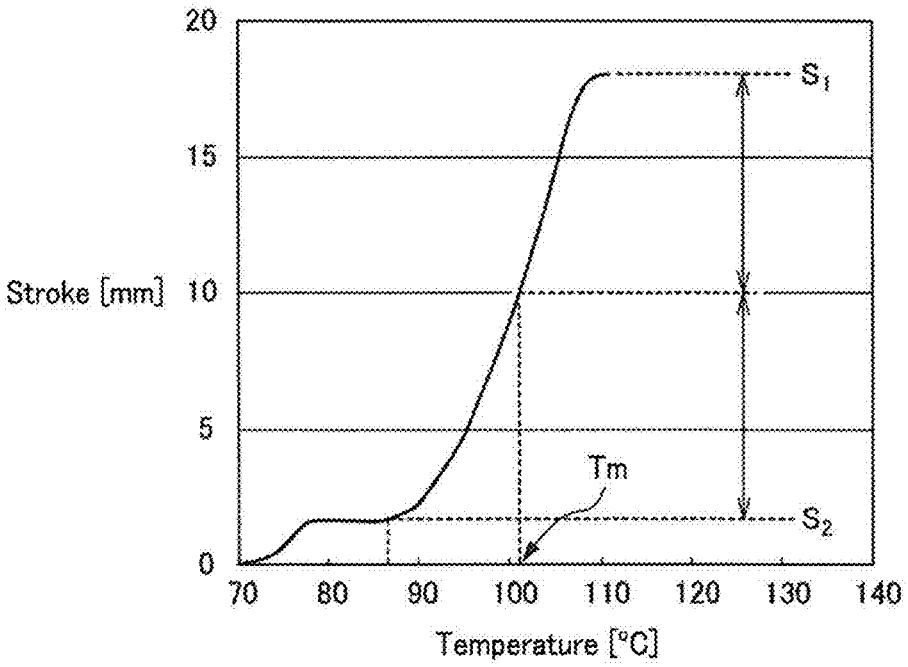
FIG. 2 is a diagram relating to a method for reading a softening point from an S-shaped curve.

A method for reading Tm of the binder resin 11*a* from the S-shaped curve is explained with reference to FIG. 2. FIG. 2 is a graph illustrating an example of the S-shaped curve.

In FIG. 2, $S_1$ indicates a maximum stroke value and $S_2$ indicates a base line stroke value at low temperatures. Tm of the measurement sample is determined to be a temperature corresponding to a point on the S-shaped curve at which the stroke value is equal to $(S_1+S_2)/2$.

The following continues explanation with reference to FIG. 1.

The binder resin 11*a* is preferably a resin having a functional group such as an ester group, a hydroxyl group, an ether group, an acid group, a methyl group, or a carboxyl group, and more preferably is a resin having either or both of a hydroxyl group and a carboxyl group in a molecule of the resin. The cores 11 (binder resin 11*a*) having a functional group such as listed above causes the cores 11 to readily chemically bond to the shell material (for example, methylol melamine) through a chemical reaction. Such chemical bonding causes the cores 11 to be strongly bound to the shell layers 12.

The binder resin 11*a* is preferably a thermoplastic resin.

Examples of preferable thermoplastic resins include styrene-based resins, acrylic-based resins, styrene-acrylic-based resins, olefin-based resins (specifically, polyethylene resins and polypropylene resins), vinyl-based resins (specifically, vinyl chloride resins, polyvinyl alcohol resins, vinyl ether resins, and N-vinyl resins), polyester resins, polyamide resins, polyurethane resins, and styrene-butadiene-based resins. Among the examples listed above, styrene-acrylic-based resins and polyester resins have excellent properties in terms of dispersibility of the colorant in the toner, chargeability of the toner, and fixability of the toner on a recording medium.

(Styrene-Acrylic-Based Resins)

The following explains styrene-acrylic-based resins that can be used as the binder resin 11*a*.

The styrene-acrylic-based resin is for example a copolymer of a styrene-based monomer and an acrylic-based monomer.

Preferable examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic-based monomer include (meth)acrylic acid, alkyl esters of (meth)acrylic acid, and hydroxyalkyl esters of (meth)acrylic acid. Preferable examples of alkyl esters of (meth)acrylic acid include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate. Preferable examples of hydroxyalkyl esters of (meth)acrylic acid include 2-hydroxyethyl (meth)acrylate, 3-hydroxypropyl (meth)acrylate, 2-hydroxypropyl (meth) acrylate, or 4-hydroxypropyl (meth)acrylate.

A hydroxyl group can be introduced into the styrene-acrylic-based resin by using a monomer having a hydroxyl group (for example, p-hydroxystyrene, m-hydroxystyrene, or a hydroxyalkyl ester of (meth)acrylic acid) during preparation of the styrene-acrylic-based resin. The hydroxyl value of the styrene-acrylic-based resin can for example be adjusted by appropriately adjusting the amount of the monomer having the hydroxyl group that is used.

A carboxyl group can be introduced into the styrene-acrylic-based resin by using (meth)acrylic acid as a monomer during preparation of the styrene-acrylic-based resin. The acid value of the styrene-acrylic-based resin can for example be adjusted by appropriately adjusting the amount of (meth)acrylic acid that is used.

When the binder resin is a styrene-acrylic-based resin, in order to improve strength of the cores 11 and fixability of the toner, the styrene-acrylic-based resin preferably has a number average molecular weight (Mn) of at least 2000 and no greater than 3000. The styrene-acrylic-based resin preferably has a molecular weight distribution (i.e., a ratio Mw/Mn of a mass average molecular weight (Mw) relative to the number average molecular weight (Mn)) of at least 10 and no greater than 20. Mn and Mw of the styrene-acrylic-based resin can be measured by gel permeation chromatography.

(Polyester Resins)

The following explains polyester resins that can be used as the binder resin 11*a*.

The polyester resin is for example prepared through condensation polymerization or condensation copolymerization of a dihydric alcohol or alcohol having three or more hydroxyl groups and a dicarboxylic acid or carboxylic acid having three or more carboxyl groups.

Preferable examples of the dihydric alcohol or alcohol having three or more hydroxyl groups, which is used to prepare the polyester resin, include diols, bisphenols, and alcohols having three or more hydroxyl groups.

Specific examples of preferable diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of preferable bisphenols include bisphenol A, hydrogenated bisphenol A, polyoxyethylenated bisphenol A, and polyoxypropylenated bisphenol A.

Specific examples of preferable alcohols having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of preferable dicarboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specifically, n-butyl succinic acid, isobutylsuccinic acid, n-octylsuccinic acid, n-dodecylsuccinic acid, and isododecylsuccinic acid), and alkenyl succinic acids (specifically, n-butenyl succinic acid, isobutenylsuccinic acid, n-octenylsuccinic acid, n-dodecenylsuccinic acid, and isododecenylsuccinic acid).

Specific examples of preferable carboxylic acids having three or more carboxyl groups that can be used in preparation of the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Alternatively, an ester-forming derivative (for example, an acid halide, an acid anhydride, or a lower alkyl ester) of the dicarboxylic acid or carboxylic acid having three or more carboxyl groups may be used. Herein the term "lower alkyl" refers to an alkyl group having 1 to 6 carbon atoms.

The acid value and the hydroxyl value of the polyester resin can be adjusted by appropriately changing the amount of the dihydric alcohol or alcohol having three or more hydroxyl groups and the amount of the dicarboxylic acid or carboxylic acid having three or more carboxyl groups used during preparation of the polyester resin. Increasing the molecular weight of the polyester resin tends to decrease the acid value and the hydroxyl value of the polyester resin.

When the binder resin is a polyester resin, in order to improve strength of the cores 11 and fixability of the toner, the polyester resin preferably has a number average molecular weight (Mn) of at least 1,200 and no greater than 2,000. The polyester resin preferably has a molecular weight distribution (i.e., a ratio Mw/Mn of a mass average molecular weight (Mw) relative to the number average molecular weight (Mn)) of at least 9 and no greater than 20. Mn and Mw of the polyester resin can be measured by gel permeation chromatography.

[Colorant (Cores)]

The colorant can for example be a commonly known pigment or dye that matches a color of the toner particles 10. The amount of the colorant is preferably at least 1 part by mass and no greater than 20 parts by mass relative to 100 parts by mass of the binder resin 11*a*, and more preferably is at least 3 parts by mass and no greater than 10 parts by mass.

(Black Colorant)

The cores 11 included in the toner particles 10 according to the present embodiment may contain a black colorant. The black colorant may for example be carbon black. Alternatively, a colorant can be used that has been adjusted to a black color using colorants such as a yellow colorant, a magenta colorant, and a cyan colorant.

(Non-Black Colorants)

The cores 11 included in the toner particles 10 according to the present embodiment may contain a non-black colorant such as a yellow colorant, a magenta colorant, or a cyan colorant.

Preferable examples of the yellow colorant include condensed azo compounds, isoindolinone compounds, anthraquinone compounds, azo metal complexes, methine compounds, and arylamide compounds. Specific examples of preferable yellow colorants include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I vat yellow.

Preferable examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of the cyan colorant include copper phthalocyanine compounds, copper phthalocyanine derivatives, anthraquinone compounds, and basic dye lake compounds. Specific examples of preferable cyan colorants include C.I. pigment blue (1, 7, 15, 15:1, 15:2, 15:3, 15:4, 60, 62, and 66), phthalocyanine blue, C.I. vat blue, and C.I. acid blue.

[Releasing Agent (Cores)]

The releasing agent is for example used to improve the fixability or the offset resistance of the toner. In order to improve the fixability or the offset resistance of the toner, the amount of the releasing agent is preferably at least 1 part by mass and no greater than 30 parts by mass relative to 100 parts by mass of the binder resin 11*a*, and more preferably is at least 5 parts by mass and no greater than 20 parts by mass.

Preferable examples of the releasing agent include: aliphatic hydrocarbon-based waxes such as low molecular weight polyethylene, low molecular weight polypropylene, polyolefin copolymer, polyolefin wax, microcrystalline wax, paraffin wax, or Fischer-Tropsch wax; oxides of aliphatic hydrocarbon-based waxes such as polyethylene oxide wax or block copolymer of polyethylene oxide wax; plant waxes such as candelilla wax, carnauba wax, Japan wax, jojoba wax, or rice wax; animal waxes such as beeswax, lanolin, or spermaceti; mineral waxes such as ozocerite, ceresin, or petrolatum; waxes having a fatty acid ester as major component such as montanic acid ester wax or castor wax; and waxes such as deoxidized carnauba wax in which a part or all of a fatty acid ester has been deoxidized.

[Charge Control Agent (Cores)]

Preferably a negatively chargeable charge control agent is used in order to strengthen the anionic nature (negative polarity) of the cores 11. The charge control agent is for example used to improve charge stability and a charge rise characteristic of the toner. The charge rise characteristic of the toner is an indicator of whether or not the toner can be charged to a specific charging level in a short period of time.

[Magnetic Powder (Cores)]

When the toner is used as a one-component developer, the amount of the magnetic powder is preferably at least 35 parts by mass and no greater than 60 parts by mass relative to 100 parts by mass of the toner overall, and more preferably is at least 40 parts by mass and no greater than 60 parts by mass. When the toner is used in a two-component developer, the amount of the magnetic powder is preferably no greater than 20 parts by mass relative to 100 parts by mass of the toner overall, and more preferably no greater than 15 parts by mass.

Preferable examples of the magnetic powder include iron (ferrite or magnetite), ferromagnetic metals (cobalt or nickel), alloys of either or both of iron and a ferromagnetic metal, compounds containing either or both of iron and a ferromagnetic metal, ferromagnetic alloys subjected to ferromagnetization such as heat treatment, and chromium dioxide.

The magnetic powder preferably has a particle size of at least 0.1 μm and no greater than 1.0 μm, and more preferably at least 0.1 μm and no greater than 0.5 μm. When the particle size of the magnetic powder is in the range described above, the magnetic powder can be readily dispersed in a uniform manner throughout the binder resin 11*a*.

[Shell Layers]

Preferably the shell material is a material that disperses in water.

In order to improve high-temperature preservability of the toner, preferably the shell layers 12 contain a thermosetting resin and more preferably contain the thermosetting resin as a major component thereof. Also, in order to improve strength, hardness, and the cationic nature of the shell layers 12, more preferably the shell layers 12 contain a nitrogen-containing thermosetting resin as a major component thereof. When the shell layers 12 contain nitrogen atoms, the shell layers 12 have a high tendency to be positively charged. In order to strengthen the cationic nature of the shell layers 12, preferably the shell layers 12 contain at least 10% by mass of nitrogen atoms.

The shell layers 12 may also contain a thermoplastic resin. Including the thermoplastic resin in the shell layers 12 enables the shell layers 12 to readily form in a uniform manner on the surface of the cores 11. In order to improve the high-temperature preservability of the toner, preferably at least 50% by mass of the total resin content of the shell layers 12 is the thermosetting resin, more preferably at least 70% by mass is the thermosetting resin, and particularly preferably 100% by mass is the thermosetting resin.

Preferable examples of the thermosetting resin contained in the shell layers 12 include melamine resins, urea resins, sulfonamide resins, glyoxal resins, guanamine resins, aniline resins, and derivatives of any of the aforementioned resins. The melamine resin is for example preferably prepared using methylol melamine. The guanamine resin is for example preferably prepared using benzoguanamine, acetoguanamine, or spiroguanamine.

The thermosetting resin contained in the shell layers 12 is for example preferably a polyimide resin having a molecular framework of nitrogen atoms. Shell layers containing a polyimide resin tend to be strongly cationic. Preferable examples of the polyimide resin contained in the shell layers include maleimide-based polymers and bismaleimide-based polymers (specifically, amino-bismaleimide polymers, bismaleimide triazine polymers).

In particular, the thermosetting resin contained in the shell layers 12 is preferably a resin (herein referred to as an amino-aldehyde resin) produced through polycondensation of an aldehyde (for example, formaldehyde) and a compound including an amino group, or a derivative of the amino-aldehyde resin. The melamine resin is a polycondensate of melamine and formaldehyde. The urea resin is a polycondensate of urea and formaldehyde. The glyoxal resin is a polycondensate of formaldehyde and a reaction product of glyoxal and urea.

The shell layers 12 preferably have a thickness of at least 1 nm and no greater than 20 nm, and more preferably of at least 1 nm and no greater than 10 nm The thickness of the shell layers 12 being no greater than 20 nm enables the shell layers 12 to be easily ruptured during fixing of the toner on a recording medium through application of heat and pressure. As a result, softening or melting of the binder resin 11*a* and the releasing agent contained in the cores 11 proceeds quickly, enabling the toner to be fixed to the recording medium at low temperatures. Also, the thickness of the shell layers 12 being no greater than 20 nm ensures that chargeability of the shell layers 12 is not excessively high, and thus ensures that an image is formed correctly.

On the other hand, the thickness of the shell layers 12 being at least 1 nm ensures that the shell layers 12 are strong enough to resist being ruptured during transportation of the toner.

The thickness of the shell layers 12 can be measured by analyzing cross-sectional TEM images of the toner particles 10 using commercially available image-analyzing software (for example, WinROOF provided by Mitani Corporation).

The shell layers 12 may contain a positively chargeable charge control agent in order to strengthen the cationic nature (positive chargeability) of the shell layers 12.

[External Additive]

The external additive 13 may adhere to the surface of the shell layer 12. The following explains the external additive 13. Toner particles that are yet to be treated with the external additive 13 are referred to as "toner mother particles".

The external additive 13 is for example used in order to improve fluidity or a handleability of the toner. In order to improve the fluidity or the handleability of the toner, the amount of the external additive 13 is preferably at least 0.5 parts by mass and no greater than 10 parts by mass relative to 100 parts by mass of the toner mother particles, and more preferably is at least 2 parts by mass and no greater than 5 parts by mass.

Preferable examples of the external additive 13 include silica and metal oxides (for example, alumina, titanium oxide, magnesium oxide, zinc oxide, strontium titanate, or barium titanate).

Also, in order to improve the fluidity or the handleability of the toner, the external additive 13 preferably has a particle size of at least 0.01 μm and no greater than 1.0 μm.

In the toner according to the present embodiment, for at least 80% by number of the toner particles 10, along at least 80% of a circumferential length of a cross-section of the toner particle 10 when the cross-section is analyzed by EELS, the shell layer 12 has a thickness of at least 5 nm and satisfies a condition that a ratio (INc/INs), expressing an intensity INc of an N-K shell absorption-edge originating from nitrogen atoms in the core 11 relative to an intensity INs of an N-K shell absorption-edge originating from nitrogen atoms in the shell layer 12, is at least 0.0 and no greater than 0.2. Also, in the toner according to the present embodiment, for at least 80% by number of the toner particles 10, along at least 80% of the circumferential length of the cross-section of the toner particle 10, the shell layer 12 has a thickness of at least 5 nm and satisfies a condition that a ratio (ISc/ISs), expressing an intensity ISc of an S-K shell absorption-edge originating from sulfur atoms in the core 11 relative to an intensity ISs of an S-K absorption-edge originating from sulfur atoms in the shell layer 12, is at least 0.0 and no greater than 0.2.

The toner according to the present embodiment has excellent properties in terms of charging amount, image density, and toner scattering amount (i.e., amount of dripped toner).

EXAMPLES

The following describes examples of the present disclosure. Table 1 shows toners A-E (electrostatic latent image developing toners) relating to the examples of the present disclosure and toners F-I (electrostatic latent image developing toners) relating to comparative examples.

TABLE 1

| | CCR | | Methylol | Shell layer film |
|---|---|---|---|---|
| Toner | Type | Amount | melamine | thickness |
| A | CCR-A | 0.060 g | 1.80 g | 6.2 nm |
| B | CCR-A | 0.055 g | 1.65 g | 5.7 nm |
| C | CCR-A | 0.048 g | 1.90 g | 6.5 nm |
| D | CCR-A | 0.048 g | 1.60 g | 5.5 nm |
| E | CCR-B | 0.048 g | 1.69 g | 5.8 nm |
| F | — | 0.000 g | 1.80 g | 6.0 nm |
| G | — | 0.000 g | 0.00 g | 0.0 nm |
| H | CCR-A | 0.045 g | 1.85 g | 6.3 nm |
| I | CCR-A | 0.060 g | 1.29 g | 4.5 nm |

The following explains, in order, a preparation method, an evaluation method, and evaluation results of the toners A-I. Note that evaluation results (values indicating shape, physical properties, or the like) for a powder (for example, a toner or toner cores) are average values measured with respect to an appropriate number of particles unless otherwise stated.

[Preparation Method of Toner A]

<Core Preparation>

The following explains a process for preparing cores (herein referred to as toner cores) of the toner particles in the preparation method of the toner A.

In the preparation method of the toner A, 750 g of a low viscosity polyester resin, 100 g of a medium viscosity polyester resin, 150 g of a high viscosity polyester resin, 55 g of a releasing agent, and 40 g of a colorant were mixed for five minutes at a rotation speed of 2400 rpm using a mixer (FM mixer manufactured by Nippon Coke & Engineering Co. Ltd.).

The low viscosity polyester resin had a Tg of 38° C. and a Tm of 65° C. The medium viscosity polyester resin had a Tg of 53° C. and a Tm of 84° C. The high viscosity polyester resin had a Tg of 71° C. and a Tm of 120° C.

KET Blue 111 (phthalocyanine blue) manufactured by DIC Corporation was used as the colorant. Carnauba Wax No. 1 manufactured by S. Kato & Co. was used as the releasing agent.

Next, a resulting mixture was melt-kneaded using a twin screw extruder (PCM-30 manufactured by Ikegai Corp.) under conditions of a material addition rate of 5 kg/hour, an axle rotation speed of 160 rpm, and a temperature range from at least 100° C. to no greater than 130° C. A melt-knead obtained through the above was subsequently cooled.

Next, the melt-knead was roughly pulverized using a mechanical pulverizer (Rotoplex 16/8 manufactured by Toa Machinery Mfg. Co., Ltd.). After the rough pulverization, fine pulverization was performed using a jet mill (Model-I Super Sonic Jet Mill manufactured by Nippon Pneumatic Mfg. Co., Ltd.). A finely pulverized product of the above was classified using a classifying apparatus (Elbow-Jet EJ-LABO manufactured by Nittetsu Mining Co., Ltd.). Through the above, toner cores having a median diameter (volume distribution standard) of 6.0 μm were obtained. The toner cores were anionic.

<Shell Layer Formation>

The following explains a process for forming shell layers in the preparation method of the toner A.

First, explanation is provided of a method for synthesizing CCR-A, which was used in formation of the shell layers. The CCR-A that was synthesized was water-soluble.

(Method for Synthesizing CCR-A)

First, 20 g of sodium vinyl sulfonate (V0043 manufactured by Tokyo Chemical Industry Co., Ltd.), 70 g of sodium acrylate (Na-AA manufactured by Asada Chemical Industry Co., Ltd.), and 10 g of 2,2'-azobis(2-methylpropionamidine) dihydrochloride (V-50 manufactured by Wako Pure Chemical Industries, Ltd.) were dissolved in 500 g of purified water. Next, a resulting solution was transferred to a 1 L separable flask. The contents of the flask were stirred while allowing the contents to react for one hour at 60° C. Next, a reaction product obtained through the above was cooled. After cooling, 10 g of the reaction product in the flask was added to a 1 L beaker containing 600 mL of ethanol (special grade ethanol manufactured by Wako Pure Chemical Industries, Ltd.). Through the above, a white precipitate was formed in the beaker. Next, the precipitate was separated through filtration and dried. Water-soluble CCR-A was obtained as a result of the process described above. The CCR-A was a copolymer of sodium vinyl sulfonate and sodium acrylate.

(Polymerization)

A 1 L three-necked flask having a thermometer and a stirring impeller was set up in a water bath. Once the flask had been set up, the internal temperature of the flask was maintained as 30° C. using the water bath. Next, 300 mL of ion exchanged water was added to the flask. The aqueous medium in the flask was adjusted to pH 4 through addition of dilute hydrochloric acid.

Next, 1.8 g of water-soluble methylol melamine (Nikaresin® S-260 manufactured by Nippon Carbide Industries Co., Inc.) and 0.060 g of the CCR-A were added to the flask and the contents of the flask were stirred, causing the water-soluble methylol melamine (initial melamine-formaldehyde condensate) and the CCR-A to dissolve in the aqueous medium.

Next, 300 g of the toner cores prepared through the process described above were added to the flask and the contents of the flask were sufficiently stirred.

Next, 300 mL of ion exchanged water was added to the flask and the contents of the flask were stirred while increasing the internal temperature of the flask to 70° C. at a rate of 1° C./minute and subsequently while maintaining the internal temperature at 70° C. for two hours.

As a result of the internal temperature being maintained at 70° C. for two hours as explained above, cationic shell layers composed mainly of thermosetting resin (melamine resin) were formed on the surface of the toner cores. The shell layers had a thickness of 6.2 mm. The contents of the flask were subsequently adjusted to pH 7 (i.e., neutralized) through addition of sodium hydroxide to the flask. The adjustment to pH 7 stopped a curing reaction of the thermosetting resin. Next, the contents of the flask were cooled to room temperature (25° C.), yielding a dispersion of toner mother particles.

(Washing and Drying)

The toner mother particles (toner cores and shell layers) were isolated by filtration (solid-liquid separation) of the toner mother particles from the dispersion thereof. After filtration, ion exchanged water was used to wash the toner mother particles that were obtained. The steps of washing and filtration were repeated alternately to further wash the toner mother particles. Next, the toner mother particles were dried. A filtrate of the aforementioned filtration had an electrical conductivity of 4 μS/cm. The electrical conductivity was measured using an electrical conductivity meter (ES-51 Handheld Conductivity/Resistivity/Salinity Meter manufactured by Horiba, Ltd.).

(External Additive)

Next, 100 parts by mass of the toner mother particles dried as described above were mixed with 0.5 parts by mass of an external additive. Dry silica particles (REA90 manufactured by Nippon Aerosil Co., Ltd.) were used as the external additive. Through the process described above, a large number of toner particles of the toner A were prepared.

[Preparation Method of Toner B]

The preparation method of the toner B was the same as the preparation method of the toner A in all aspects other than that during formation of the shell layers, the additive amount of the CCR-A was 0.055 g instead of 0.060 g and the additive amount of the water-soluble methylol melamine (Nikaresin S-260) was adjusted such that the thickness (film thickness) of the shell layers was 5.7 nm (refer to Table 1).

[Preparation Method of Toner C]

The preparation method of the toner C was the same as the preparation method of the toner A in all aspects other than that during formation of the shell layers, the additive amount of the CCR-A was 0.048 g instead of 0.060 g and the additive amount of the water-soluble methylol melamine (Nikaresin S-260) was adjusted such that the thickness (film thickness) of the shell layers was 6.5 nm (refer to Table 1).

[Preparation Method of Toner D]

The preparation method of the toner D was the same as the preparation method of the toner A in all aspects other than that during formation of the shell layers, the additive amount of the CCR-A was 0.048 g instead of 0.060 g and the additive amount of the water-soluble methylol melamine (Nikaresin S-260) was adjusted such that the thickness (film thickness) of the shell layers was 5.5 nm (refer to Table 1).

[Preparation Method of Toner E]

The preparation method of the toner E was the same as the preparation method of the toner A in all aspects other than that during formation of the shell layers, CCR-B was used instead of the CCR-A, the additive amount of the CCR-B was 0.048 g, and the additive amount of the water-soluble methylol melamine (Nikaresin S-260) was adjusted such that the thickness (film thickness) of the shell layers was 5.8 nm (refer to Table 1).

The following explains a method for synthesizing the CCR-B. The CCR-B which was synthesized was water-soluble.

First, 20 g of sodium styrene sulfonate (special grade sodium styrene sulfonate manufactured by Wako Pure Chemical Industries, Ltd.), 70 g of hydroxyethyl methacrylate, and 10 g of 2,2'-azobis(2-methylpropionamidine) dihydrochloride (V-50 manufactured by Wako Pure Chemical Industries, Ltd.) were dissolved in 500 g of purified water. Steps of polymerization, filtration, and drying were performed on a solution obtained through the above under the same conditions as the aforementioned steps were performed during preparation of the CCR-A described above. Through the process described above, the water-soluble CCR-B was prepared.

[Preparation Method of Toner F]

The preparation method of the toner F was the same as the preparation method of the toner A in all aspects other than that during formation of the shell layers, the CCR-A was not used and the additive amount of the water-soluble methylol melamine (Nikaresin S-260) was adjusted such that the thickness (film thickness) of the shell layers was 6.0 nm (refer to Table 1).

[Preparation Method of Toner G]

The preparation method of the toner G was the same as the preparation method of the toner A in all aspects other than that shell layers were not formed.

[Preparation Method of Toner H]

The preparation method of the toner H was the same as the preparation method of the toner A in all aspects other than that during formation of the shell layers, the additive amount of the CCR-A was 0.045 g instead of 0.060 g and the additive amount of the water-soluble methylol melamine (Nikaresin S-260) was adjusted such that the thickness (film thickness) of the shell layers was 6.3 nm (refer to Table 1).

[Preparation Method of Toner I]

The preparation method of the toner I was the same as the preparation method of the toner A in all aspects other than that during formation of the shell layers, the additive amount of the water-soluble methylol melamine (Nikaresin S-260) was adjusted such that the thickness (film thickness) of the shell layers was 4.5 nm (refer to Table 1).

[Evaluation Method]

The following explains the evaluation method of the toners A-I.

(Core Coverage Ratio)

Figure 3:
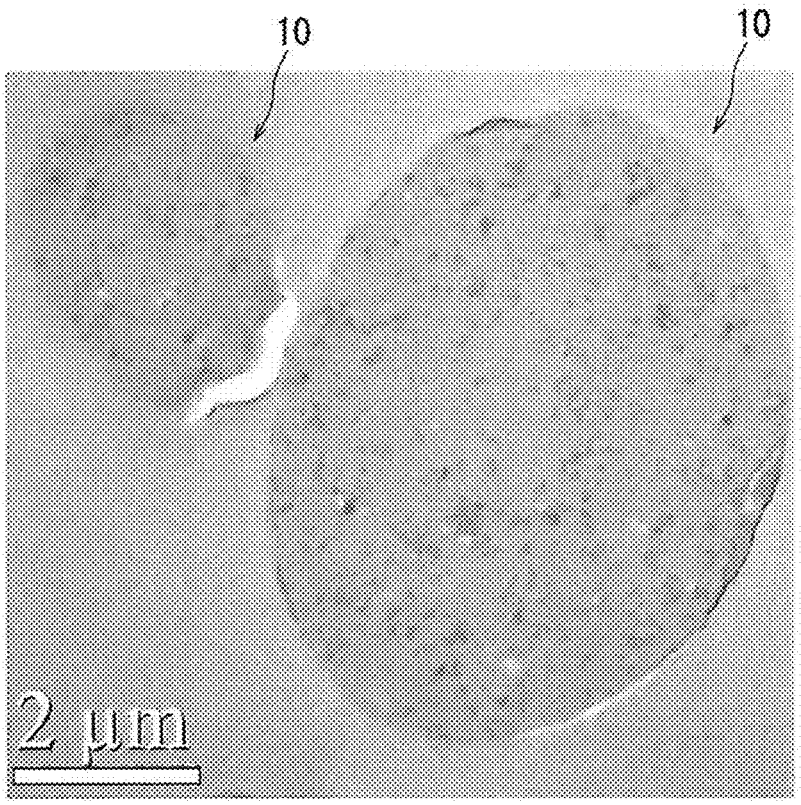
FIG. 3 is a transmission electron microscopy (TEM) image illustrating a cross-section of a sample in an example of the present disclosure.

First, the toner was dispersed in a cold setting epoxy resin and left to harden for two days at an ambient temperature of 40° C. to yield a hardened material. The hardened material was dyed in osmium tetroxide and subsequently a flake sample of 200 nm in thickness was cut therefrom using a microtome (EM UC6 manufactured by Leica Microsystems) equipped with a diamond knife. A cross-sectional image of the sample was captured using a field emission type transmission electron microscope (JEM-2100F manufactured by JEOL Ltd.) with an accelerating voltage of 200 kV. FIG. 3 is a TEM image illustrating an example of a cross-section of the sample (cross-section of the toner particles 10). Measurement targets were determined from among the aforementioned sample by randomly selecting 100 of the toner particles 10 captured in TEM images. However, among the cross-sections imaged using TEM (i.e., cross-sections of the toner particles 10), cross-sections having a major axis (i.e., a largest diameter) of less than 3 μm were excluded from being measurement targets.

Next, each captured TEM image was analyzed using an electron energy loss spectrometer (GIF TRIDEM® manufactured by Gatan, Inc.), having an energy resolution of 1.0 eV and a beam diameter of 1.0 nm, and image-analyzing software (WinROOF 5.5.0 provided by Mitani Corporation). More specifically, an EELS intensity map was generated for atoms (carbon, oxygen, nitrogen, and sulfur) contained in the shell layer. Each pixel of the image (captured TEM image) was a 5 nm square.

Figure 4:
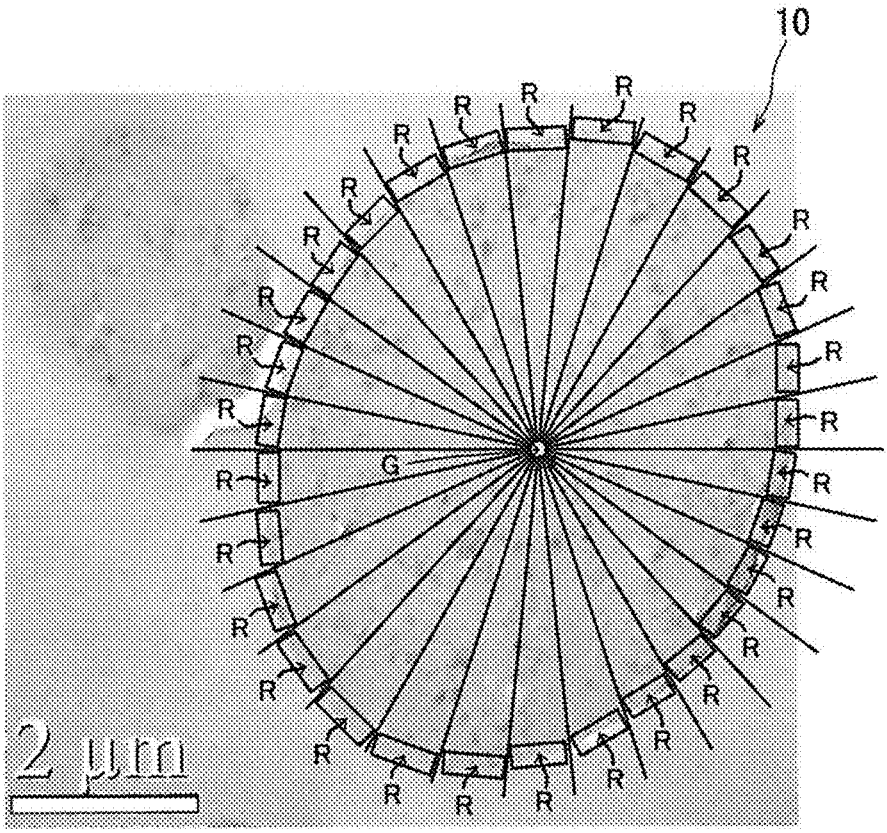
FIG. 4 is a diagram relating to a method for generating an EELS intensity map (mapping) in an example of the present disclosure.
Figure 5:
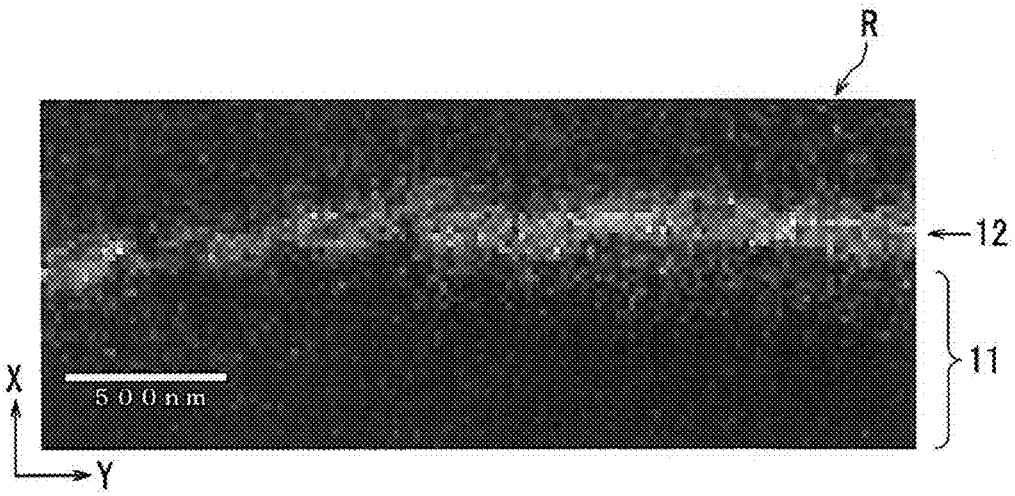
FIG. 5 illustrates an EELS intensity mapping image in an example of the present disclosure.

The following explains generation of the EELS intensity map (mapping) with reference mainly to FIGS. 4 and 5.

First, the image-analyzing software (WinROOF) was used to identify a center of mass G of the toner particle 10 as illustrated in FIG. 4. Next, lines were extended radially from the center of mass G, thereby partitioning the surface of the toner particle 10 into 30 regions R. Mapping was subsequently performed for carbon, oxygen, nitrogen, and sulfur with respect to each of the partitions (regions R) using the electron energy loss spectrometer.

FIG. 5 illustrates an example of a mapping image in which an EELS intensity map has been generated for the region R. The region R had a length of 500 pixels in terms of a Y-direction which corresponds to a circumferential direction of the toner particle 10.

In the mapping image generated using the image-analyzing software (WinROOF), the EELS intensity was proportional to whiteness of the mapping image. Image density division was performed using a density calibration function of the image-analyzing software (WinROOF). More specifically, image densities were divided into 256 different values by determining a whitest section to have a value of 255 and a blackest section to have a value of 0.

The cross-section of the toner particle 10 was analyzed by EELS to detect the shell layer 12 satisfying conditions (1) and (2) shown below.

(1) A ratio (INc/INs), expressing an intensity INc of an N-K shell absorption-edge originating from nitrogen atoms in the core 11 relative to an intensity INs of an N-K shell absorption-edge originating from nitrogen atoms in the shell layer 12, is at least 0.0 and no greater than 0.2.

(2) Thickness of the shell layer 12 is at least 5 nm

During the aforementioned detection, the EELS intensity of the N-K shell absorption-edge originating from nitrogen atoms in the core 11 was measured in the region R. The following explains a method for measuring the EELS intensity of the core 11 with reference mainly to FIGS. 6 and 7.

Figure 6:
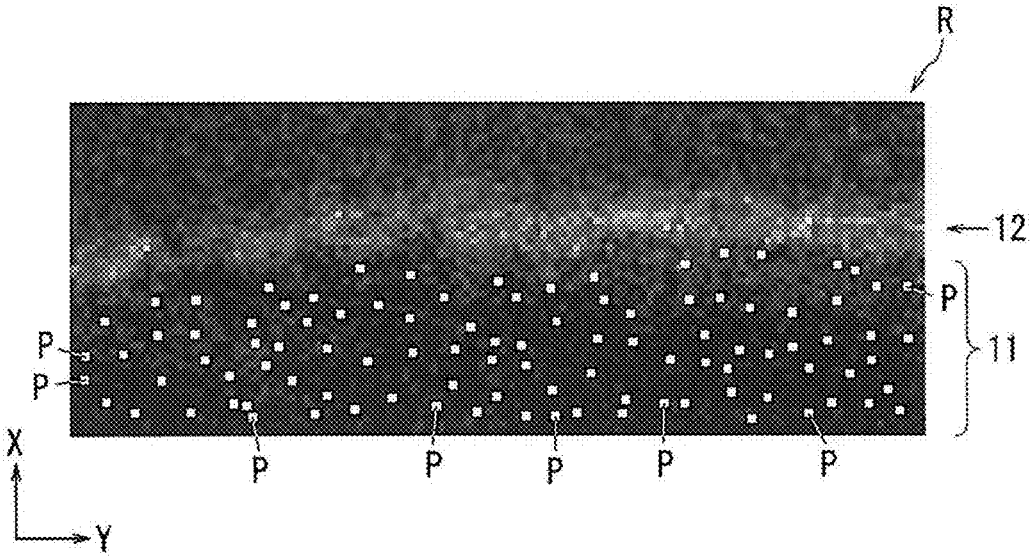
FIG. 6 is a diagram relating to a method for measuring EELS intensity of a core in an example of the present disclosure.

First, 100 positions in a region of the mapping image corresponding to the core 11 were randomly selected as measurement positions P as illustrated in FIG. 6. Next, the EELS intensity was measured at each of the 100 selected measurement positions P. The EELS intensity was measured on a 256-value scale. As illustrated in FIG. 7, subsequently an average value was calculated for the 100 EELS intensities measured as described above. More specifically, the EELS intensity of an N-K shell absorption-edge originating from nitrogen atoms in the core 11 was measured for each of the 100 measurement positions P. The average value for the 100 EELS intensities that were measured was determined to be the intensity INc (i.e., the value used for evaluation).

In order to satisfy condition (1), the intensity INs must be at least five times as large as the intensity INc (i.e., INc×5≤INs). For example, when the intensity INc is 6.8 for a given pixel, the pixel satisfies condition (1) if the intensity INs is at least 34 (=6.8×5). As explained above, each of the pixels is a 5 nm square in the image. Therefore, the shell layer 12 was determined to have a thickness of at least 5 nm (i.e., satisfying condition (2)) when at least one pixel was present at the surface of the core 11 as the shell layer 12 satisfying condition (1).

Next, the EELS intensity (intensity INs) of an N-K shell absorption-edge originating from nitrogen atoms in the shell layer 12 was measured in the region R in order to detect the shell layer 12 satisfying conditions (1) and (2). More specifically, a binarization function of the image-analyzing software (WinROOF) was used to identify pixels in the image (captured TEM image) as the shell layer 12 satisfying condition (1). As explained above, condition (2) was determined to be satisfied so long as at least one pixel was identified as the shell layer 12 satisfying condition (1).

Next, the length of the shell layer 12 satisfying conditions (1) and (2) in region R (more specifically, at the surface of the toner core 11) was measured. The following explains a method for measuring the length of the shell layer 12 with reference mainly to FIG. 8.

Figure 8:
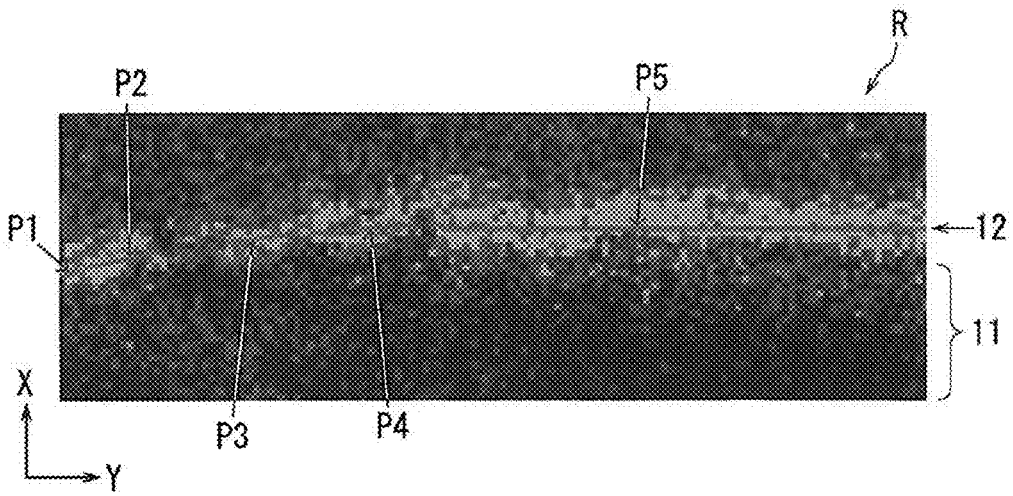
FIG. 8 is a diagram relating to a method for measuring length of a shell layer in an example of the present disclosure.

The length of the shell layer 12 was measured using a measurement function (manual measurement function and line length measurement function) of the image-analyzing software (WinROOF). More specifically, as illustrated in FIG. 8, the image-analyzing software (WinROOF) converted the shell layer 12 into lines P1-P5, and calculated the length of each of the lines P1-P5 and the total length of the lines P1-P5. The following measurement values were obtained in an example of the aforementioned measurement.

Length of line P1: 10.466 pixels
Length of line P2: 41.254 pixels
Length of line P3: 33.496 pixels
Length of line P4: 57.154 pixels
Length of line P5: 276.344 pixels
Total length of lines P1-P5: approximately 419 pixels Next, a proportion of the surface of the core 11 that was covered by the shell layer 12 satisfying conditions (1) and (2) (i.e., a coverage ratio of the core 11) was calculated for the region R. Specifically, the aforementioned calculation was performed by dividing the total length (i.e., the number of pixels) of the shell layer 12 satisfying conditions (1) and (2) by 500 pixels. Note that 500 pixels is equivalent to the length of the region R in the Y-direction (circumferential direction of the toner particle 10). In the example shown above, the total length of the lines P1-P5 was approximately 419 pixels, and thus the coverage ratio of the core 11 was 83.8% (=419×100/500).

Next, a proportion of the surface of the core 11 covered by the shell layer 12 satisfying conditions (1) and (2) (herein referred to as a coverage ratio Rn) was calculated for the entire circumference of the core 11. The following explains a method for calculating the coverage ratio Rn with reference mainly to FIGS. 9, 10A, and 10B.

As illustrated in FIG. 9, a coverage ratio of the core 11 was calculated for each of the 30 regions R resulting from partitioning (refer to FIG. 4) in the same way as explained above. An average value of the 30 coverage ratios obtained through the above calculation was determined to be the coverage ratio Rn (i.e., the value used for evaluation).

Figure 10A:
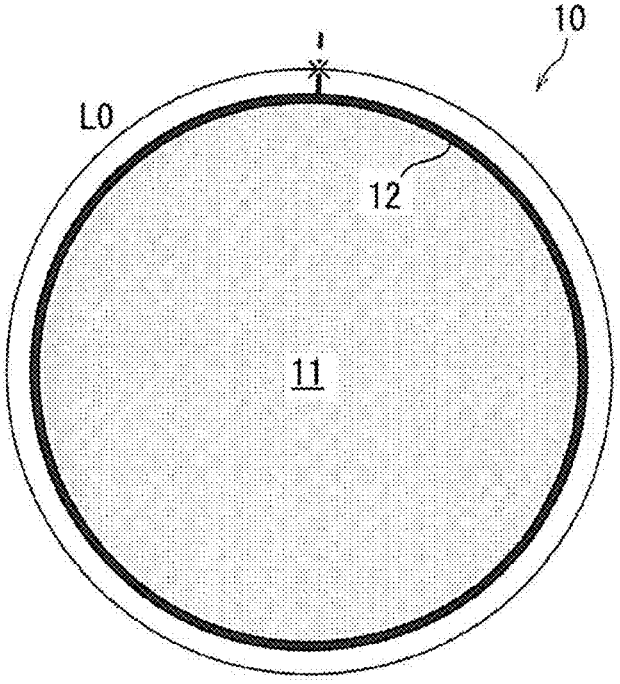
FIG. 10A is a diagram relating to a method for calculating a coverage ratio of a core in an example of the present disclosure.

FIG. 10A illustrates an example in which the coverage ratio Rn of the toner particle 10 is 100%. Length L0 shown in FIG. 10A indicates the circumferential length of the cross-section of the toner particle 10.

Figure 10B:
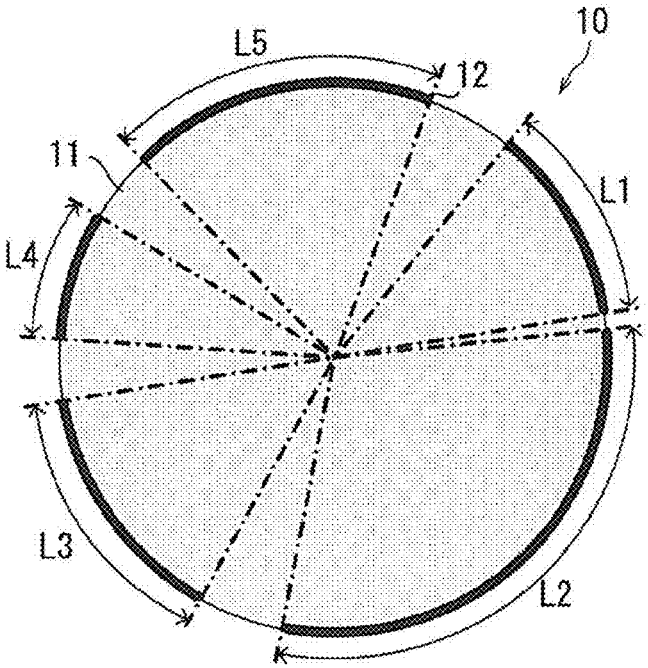
FIG. 10B is a diagram relating to a method for calculating a coverage ratio of a core in an example of the present disclosure.

FIG. 10B illustrates an example in which the core 11 of the toner particle 10 is partially covered by the shell layer 12 satisfying conditions (1) and (2). Lengths L1-L5 shown in FIG. 10B indicate lengths where the shell layer 12 satisfying conditions (1) and (2) is present. The coverage ratio Rn was calculated by dividing the total of the lengths L1-L5 by the length L0. Thus, the coverage ratio Rn was calculated based on an expression: Rn=100×(L1+L2+L3+L4+L5)/L0.

As illustrated in FIG. 9, each of the 100 toner particles 10 (i.e., the measurement targets) was evaluated as to whether or not the coverage ratio Rn thereof was at least 80%. A number of toner particles 10, among the 100 toner particles 10 (measurement targets), for which the coverage ratio Rn was at least 80% was calculated. Note that a toner particle 10 having a coverage ratio Rn of at least 80% signifies that the shell layer 12 satisfying conditions (1) and (2) is present along at least 80% of the circumferential length (length L0) of the cross-section of the toner particle 10.

Next, a proportion of the surface of the core 11 covered by the shell layer 12 satisfying conditions (3) and (4) shown below (herein referred to as a coverage ratio Rs) was calculated for the entire circumference of the core 11 in the same way as the coverage ratio Rn.

(3) A ratio (ISc/ISs), expressing an intensity ISc of an S-K shell absorption-edge originating from sulfur atoms in the core 11 relative to an intensity ISs of an S-K shell absorption-edge originating from sulfur atoms in the shell layer 12, is at least 0.0 and no greater than 0.2.

(4) Thickness of the shell layer 12 is at least 5 nm

The EELS intensity of the S-K shell absorption-edge originating from sulfur atoms in the core 11 was measured at each of the 100 measurement positions P (refer to FIG. 6). An average value for the 100 EELS intensities that were measured was determined to be the intensity ISc (i.e., the value used for evaluation) (refer to FIG. 7). The measurement positions P used in measurement of the intensity ISc were the same as the measurement positions P used in measurement of the intensity INc.

Next, a proportion of the surface of the core 11 that was covered by the shell layer 12 satisfying conditions (3) and (4) (coverage ratio of the core 11) was calculated for the region R (refer to FIG. 8). The coverage ratio of the core 11 was calculated in the same way for each of the 30 regions R resulting from partitioning (refer to FIG. 4). An average value of the 30 coverage ratios obtained through the above calculation was determined to be a coverage ratio Rs (i.e., the value used for evaluation).

Each of the 100 toner particles 10 (measurement targets) was evaluated as to whether or not the coverage ratio Rs was at least 80%. Also, the number of the toner particle 10 for which the coverage ratio Rs was at least 80% was calculated.

<<Shell Layer Thickness>>

A sample (toner) was dispersed in a cold setting epoxy resin and left to stand for two days at an ambient temperature of 40° C. to yield a hardened material. The hardened material was dyed in osmium tetroxide and subsequently a flake sample of 200 nm in thickness was cut therefrom using a microtome (EM UC6 manufactured by Leica Microsystems) equipped with a diamond knife. Cross-sectional TEM images of the flake sample were subsequently captured using a transmission electron microscope (JEM-2100F manufactured by JEOL Ltd.).

The thickness of the shell layer was measured by analyzing the TEM image using image-analyzing software (WinROOF 5.5.0 provided by Mitani Corporation). More specifically, on a cross-section of a toner particle, two straight lines were drawn to intersect at right angles at approximately the center of the cross-section. Next, lengths of four line segments of the two straight lines were measured at four locations at which the line segments crossed the shell layer. An average value of the lengths measured at the four locations was determined to be the thickness of the shell layer of the one toner particle subjected to the measurement. The thickness of the shell layer was calculated for each of ten toner particles included in the toner and an average value of the ten measured shell layer thicknesses was determined to be an evaluation value.

When the shell layer is excessively thin, the TEM image may not clearly depict a boundary between the toner core and the shell layer, complicating measurement of thickness of the shell layer. In such a situation, the thickness of the shell layer was measured using TEM and EELS in combination in order to clarify the boundary between the toner core and the shell layer. More specifically, an element (for example, nitrogen) contained in the shell layer was mapped in the TEM image using EELS.

(Charging amount, image density, and toner scattering amount)

A two-component developer was prepared by mixing 100 parts by mass of a developer carrier (carrier for TASKalfa5550) and 10 parts by mass of the toner for 30 minutes using a ball mill The charging amount of the two-component developer directly after preparation was measured at a temperature of 20° C. and a relative humidity of 60%. The two-component developer preferably has a charging amount directly after preparation of at least 30 μC/g and less than 60 μC/g.

Printing (image formation) was performed on 100,000 successive recording sheets (plain paper) at a printing coverage of 5%, a temperature of 20° C., and a relative humidity of 60%, using a color multifunction peripheral (TASKalfa5550 manufactured by KYOCERA Document Solutions Inc.). After printing, the charging amount of the toner, the image density (ID), and an amount of toner that had dripped in the developing device during printing (i.e., the toner scattering amount) were measured. The charging amount of the toner is preferably at least 8 μC/g and less than 25 μC/g. The image density (ID) is preferably at least 1.2. The toner scattering amount (amount of dripped toner) is preferably no greater than 200 mg.

The charging amount was measured using a Q/m meter (Model 210HS-1 manufactured by TREK, Inc.). The image density (ID) was measured using a spectrophotometer (SpectroEye manufactured by Sakata Inx Eng. Co., Ltd.). The toner scattering amount (amount of dripped toner) was measured by collecting toner that had dripped in the developing device. The mass of the collected toner was then measured.

[Evaluation Results]

Evaluation results of the toners A-I are shown in Table 2. Note that evaluation results of shell layer thickness are shown further above in Table 1.

TABLE 2

| | Toner | Number of particles satisfying INc/INs ≤ 0.2 | Number of particles satisfying ISc/ISs ≤ 0.2 | Charging amount directly after developer preparation (μC/g) | After printing 100,000 sheets: Charging amount (μC/g) | ID | Toner scattering amount (mg) |
|---|---|---|---|---|---|---|---|
| Example 1 | A | 98 | 99 | 45 | 20 | 1.4 | 48 |
| Example 2 | B | 81 | 99 | 32 | 9 | 1.5 | 155 |
| Example 3 | C | 99 | 83 | 56 | 24 | 1.2 | 30 |
| Example 4 | D | 80 | 84 | 45 | 10 | 1.5 | 180 |
| Example 5 | E | 89 | 85 | 39 | 15 | 1.5 | 75 |
| Comparative example 1 | F | 93 | 0 | 108 | 120 | 0.5 | 20 |
| Comparative example 2 | G | 0 | 0 | −10 | — | — | — |
| Comparative example 3 | H | 95 | 74 | 84 | 45 | 1.0 | 120 |
| Comparative example 4 | I | 70 | 99 | 25 | 4 | 1.3 | 321 |

As shown in Table 2, with regards to each of the toners A-E (toners relating to Examples 1-5), for at least 80% by number of the toner particles, along at least 80% of a circumferential length of a cross-section of the toner particle (i.e., the toner particle has a coverage ratio Rn of at least 80%) when the cross-section is analyzed by EELS, the shell layer has a thickness of at least 5 nm and satisfies a condition that a ratio (INc/INs), expressing an intensity INc of an N-K shell absorption-edge originating from nitrogen atoms in the toner core relative to an intensity INs of an N-K absorption edge originating from nitrogen atoms in the shell layer, is at least 0.0 and no greater than 0.2. Also, with regards to each of the toners A-E, for at least 80% by number of the toner particles, along at least 80% of the circumferential length of the cross-section of the toner particle (i.e., the toner particle has a coverage ratio Rs of at least 80%), the shell layer has a thickness of at least 5 nm and satisfies a condition that a ratio (ISc/ISs), expressing an intensity ISc of an S-K shell absorption-edge originating from sulfur atoms in the toner core relative to an intensity ISs of an S-K absorption edge originating from sulfur atoms in the shell layer, is at least 0.0 and no greater than 0.2.

With regards to each of the toners F and H (toners relating to Comparative Examples 1 and 3), at least 80% by number of the toner particles have a coverage ratio Rn of at least 80%. However, in each of the toners F and H fewer than 80% by number of the toner particles have a coverage ratio Rs of at least 80%.

With regards to the toner I (toner relating to Comparative Example 4), at least 80% by number of the toner particles have a coverage ratio Rs of at least 80%. However, in the toner I fewer than 80% by number of the toner particles have a coverage ratio Rn of at least 80%.

With regards to charging amount of the two-component developer directly after preparation thereof, the charging amount was at least 30 μC/g and less than 60 μC/g for each of the toners A-E, at least 60 μC/g for each of the toners F and H, and less than 30 μC/g for each of the toners G and I.

With regards to the charging amount of the two-component developer after printing 100,000 sheets, the charging amount was at least 8 μC/g and less than 25 μC/g for each of the toners A-E, at least 25 μC/g for each of the toners F and H, and less than 8 μC/g for the toner I. Note that evaluation after printing 100,000 sheets was not performed for the toner G due it not being possible to form an image using the toner G With regards to the image density (ID) after printing 100,000 sheets, the measured value for image density was at least 1.2 for each of the toners A-E and I, and less than 1.2 for each of the toners F and H. Note that evaluation after printing 100,000 sheets was not performed for the toner G due it not being possible to form an image using the toner G.

With regards to the toner scattering amount (amount of dripped toner) after printing 100,000 sheets, the toner scattering amount was no greater than 200 mg for each of the toners A-F and H. The toner scattering amount for the toner I was greater than 200 mg. Note that evaluation after printing 100,000 sheets was not performed for the toner G due it not being possible to form an image using the toner G As explained above, the toners A-E each had excellent properties in terms of charging amount, image density, and toner scattering amount (amount of dripped toner). Also, in each of the toners A-E, the toner cores were anionic and the shell layers were cationic. The shell layers contained a thermosetting resin. The shell layers had a thickness of at least 5.5 nm and no greater than 6.5 nm (refer to Table 1).

The present disclosure is not in any way limited by the above examples. The toner has excellent properties in terms of charging amount, image density, and toner scattering amount (amount of dripped toner) so long as at least 80% by number of the toner particles have a coverage ratio Rn of at least 80% and at least 80% by number of the toner particles have a coverage ratio Rs of at least 80%.

What is claimed is:

1. A toner comprising toner particles, each including:

a core; and a shell layer covering a surface of the core, wherein the core contains a binder resin, the binder resin has an amino group or an amine group or an amide group, and a sulfur compound, the shell layer contains a nitrogen-containing thermosetting resin and a sulfur-containing resin, the nitrogen-containing thermosetting resin is a melamine resin, the sulfur-containing resin is a copolymer of sodium vinyl sulfonate and sodium acrylate or a copolymer of sodium styrene sulfonate and hydroxyethyl methacrylate, for at least 80% by number of the toner particles, along at least 80% of a circumferential length of a cross-section of the toner particle, the shell layer has a thickness of at least 5 nm and satisfies a condition that a ratio of INc relative to INs is at least 0.0 and no greater than 0.2, for at least 80% by number of the toner particles, along at least 80% of the circumferential length of the cross-section of the toner particle, the shell layer has a thickness of at least 5 nm and satisfies a condition that a ratio of ISc relative to ISs is at least 0.0 and no greater than 0.2, the INs indicates an intensity of a K shell absorption-edge originating from nitrogen atoms in the nitrogen-containing thermosetting resin in the shell layer in an electron energy loss spectrum obtained through measurement of the cross-section of the toner particle by electron energy loss spectroscopy, the INc indicates an average value of intensities of K shell absorption-edges originating from nitrogen atoms in the binder resin in electron energy loss spectra obtained through measurement by electron energy loss spectroscopy with respect to randomly selected 100 positions in a region corresponding to the core in the cross-section of the toner particle, the ISs indicates an intensity of a K shell absorption-edge originating from sulfur atoms in the sulfur-containing resin in the shell layer in an electron energy loss spectrum obtained through measurement of the cross-section of the toner particle by electron energy loss spectroscopy, and the ISc indicates an average value of intensities of K shell absorption-edges originating from sulfur atoms in the binder resin in electron energy loss spectra obtained through measurement by electron energy loss spectroscopy with respect to randomly selected 100 positions in a region corresponding to the core in the cross-section of the toner particle.

2. A toner according to claim 1, wherein the shell layer has a thickness of at least 5.5 nm and no greater than 6.5 nm.

3. A toner according to claim 2, wherein the shell layer contains no dispersant.

4. A toner according to claim 1, wherein the core contains no charge control agent.

5. A toner according to claim 1, wherein the core contains, as the binder resin, three polyester resins each having a different softening point.

* * * * *